US009543627B2

(12) United States Patent
Kim et al.

(10) Patent No.: US 9,543,627 B2
(45) Date of Patent: Jan. 10, 2017

(54) MICROWAVE DEVICE USING MAGNETIC MATERIAL NANO WIRE ARRAY AND MANUFACTURING METHOD THEREOF

(71) Applicant: Electronics and Telecommunications Research Institute, Daejeon (KR)

(72) Inventors: Yark Yeon Kim, Daejeon (KR); Han Young Yu, Daejeon (KR); Yong Sun Yoon, Daejeon (KR); Won Ick Jang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 134 days.

(21) Appl. No.: 14/518,889

(22) Filed: Oct. 20, 2014

(65) Prior Publication Data

US 2015/0137904 A1 May 21, 2015

(30) Foreign Application Priority Data

Nov. 19, 2013 (KR) ..... 10-2013-0140705
Jul. 17, 2014 (KR) ..... 10-2014-0090501

(51) Int. Cl.

| | |
|---|---|
| ***H01P 1/387*** | (2006.01) |
| ***H01P 1/38*** | (2006.01) |
| ***C25D 11/04*** | (2006.01) |
| ***C25D 11/20*** | (2006.01) |
| ***C25D 1/00*** | (2006.01) |

(52) U.S. Cl.
CPC ..... *H01P 1/38* (2013.01); *C25D 1/006* (2013.01); *C25D 11/045* (2013.01); *C25D 11/20* (2013.01); *H01P 1/387* (2013.01)

(58) Field of Classification Search
CPC ..... H01P 1/32; H01P 1/36; H01P 1/38; H01P 1/387
USPC ..... 333/1.1, 24.2
See application file for complete search history.

(56) References Cited

U.S. PATENT DOCUMENTS 8,119,430 B2 2/2012 Park et al.

FOREIGN PATENT DOCUMENTS

| | | | |
|---|---|---|---|
| KR | 10-0269587 | A | 10/2000 |
| KR | 10-0312408 | A | 1/2002 |
| KR | 10-2010-0040482 | A | 4/2010 |

OTHER PUBLICATIONS

Darques et al., Microwave Circulator Based on Ferromagnetic Nanowires in an Alumina Template,Mar. 2010.*

* cited by examiner

*Primary Examiner* — Stephen E Jones

(57) ABSTRACT

Provided herein is a microwave device using a magnetic material nano wire array and a manufacturing method thereof, the device including a template having a nano hole array filled with a metal magnetic material.

14 Claims, 5 Drawing Sheets

MICROWAVE DEVICE USING MAGNETIC MATERIAL NANO WIRE ARRAY AND MANUFACTURING METHOD THEREOF

CROSS-REFERENCE TO RELATED APPLICATION

The present application claims priority to Korean patent application numbers 10-2013-0140705, filed on Nov. 19, 2013 and 10-2014-0090501, filed on Jul. 17, 2014, the entire disclosure of which is incorporated herein in its entirety by reference.

BACKGROUND

1. Field of Invention

Various embodiments of the present invention relate to a microwave device and a manufacturing method thereof, and more particularly to a circulator puck using a magnetic material nano wire array and a manufacturing method thereof.

2. Description of Related Art

In microwave communication, a circulator is a device that that can be directly connected to an antenna. Connected to the antenna, the circulator plays the role of changing the connection state to and from transmission and reception. An isolator is a device that has a function of proceeding microwaves in only one direction just as a diode of in a semiconductor device.

FIG. 1 is a view for explaining operation principles of a circulator. As illustrated in FIG. 1, the circulator adjusts the direction of progress of a microwave using changes in the phase velocity of the microwave due to changes in the permeability of a magnetic material regarding the microwave. Such operations of the circulator are based on the principle of the magnetic material making precession motions as the magnetic moment is aligned (magnetization) when an external static magnetic field is applied.

In general, when a linear polarized microwave enters a magnetic material, the linear polarized microwave may be decomposed into two circular polarized microwaves. That is, the linear polarized microwave may be divided into a left-circular polarized light and a right-circular polarized light, and the permeability, that is the reaction of ferrite due to the magnetic field of each of the left-circular polarized light and the right-circular light will be different from each other. In other words, due to the difference of phase velocity between the permeability ($\mu'+$) of the light polarized in the same direction as the precession and the permeability ($\mu'-$) of the light polarized in the opposite direction, the direction of progress will rotate as illustrated in the enlarged part (p) of FIG. 1.

Therefore, in order to rotate the direction of progress of such a wave by a certain angle, the magnetic moment of the ferrite puck must be aligned in a certain direction, and in order to do this, a conventional circulator is manufactured to include a permanent magnet for applying a magnetic field.

Conventional circulators mostly have a waveguide structure illustrated in FIG. 2*a* or a microstrip structure illustrated in FIG. 2*b*. They may also be configured in other various structures such as a stripline structure or a lumped element structure. Waveguide type circulators include a waveguide 3, and microstrip structure circulators include a metal stripline 4.

Such a conventional circulator is fitted with a magnetic material ferrite puck and a permanent magnet. More particularly, a conventional circulator includes a ferrite puck 1 of a soft magnetic material and a permanent magnet 2 for applying a magnetic field to the ferrite puck.

The permanent magnet that accounts for a significant portion of a circulator increases the cost of the circulator, and further, it is difficult to integrate the circulator with a substrate.

Not only that, for a conventional circulator, an insulating ferrite puck has to be used to minimize the loss of microwaves, and such insulating characteristics of the ferrite cannot easily release the heat energy that is generated when high power microwaves are applied, causing nonlinear characteristics and consequently deteriorating the efficiency of the circulator.

The need to use a permanent magnet can be resolved by developing a puck that can operate even when an external magnetic field is not applied by using hard magnetic (permanent magnet) materials such as Sr (strontium) ferrite or Ba (barium) ferrite, but these materials have their unique magnetic characteristics and thus cause the problem of having to operate at high frequencies only. Therefore, there still remains the problem that such a circulator cannot be used in various frequencies, and also the problem of relatively high magnetic loss.

SUMMARY

A first purpose of various embodiments of the present invention is to provide a circulator that can operate without an external magnetic field applied, and that can reduce nonlinear effects when high power microwaves are applied.

According to an embodiment of the present invention, there is provided a microwave device having a magnetic material nano wire array, the device including a template having an array of nano holes, each of the nano holes extending from a first surface of the template to a second surface of the template opposite the first surface, wherein the nano holes may be filled with a metal magnetic material to form an array of magnetic material nano wires, at least one end of each of the magnetic material nano wires extending to the second surface of the template, and a magnetic material layer formed on the second surface of the template and that is in contact with the ends of the magnetic material nano wires that extends to the second surface of the template.

Each nano hole of the array of nano holes may be partially filled with the metal magnetic material.

The device may further include a first electrode formed on the first surface of the template; and a second electrode formed on a first surface of the metal magnetic material layer that is opposite to a second surface of the metal magnetic material layer, where the second surface of the metal magnetic material layer is disposed on the second surface of the template and on the ends of the magnetic material nano wires that extends to the second surface of the template.

The geometric structure of a nano hole included in the array of nano holes may include a cylindrical shape or polygonal column shape.

The distances between nano holes included in the array of nano holes may be uniform or partially different from one another.

At least one of a geometric structure of a nano hole included in the array of nano holes, distance between the nano holes, type of metal magnetic material filled in the array of nano holes, and amount of metal magnetic material filled in the nano holes of the array of nano holes based on the frequency of an electromagnetic wave that is designed to be applied to the microwave device using the array of nano wires.

The metal magnetic material that forms each of the nano wires of the array of nano wires having may have a same spin direction.

According to an embodiment of the present invention, there is provided a method for manufacturing a microwave device having a magnetic material nano wire array, the method including forming a template having an array of nano holes, each of the nano holes extending from a first surface of the template to a second surface of the template opposite the first surface; filling the nano holes with a metal magnetic material to form an array of magnetic material nano wires, at least one end of each magnetic material nano wire extending to the second surface of the template; and forming a magnetic material layer on the second surface of the template and on the ends of the nano wires that extends to the second surface of the template.

The filling the nano holes with a metal magnetic material may involve filling only a portion of each of the nano holes with the metal magnetic material.

The method may further include forming a first electrode on the first surface of the template; and forming a second electrode on a first surface of the metal magnetic material layer that is opposite to a second surface of the metal magnetic material layer, where the second surface of the metal magnetic material layer is disposed on the second surface of the template and on the ends of the magnetic material nano wires that extends to the second surface of the template.

The template may be an alumina template, and the forming a template having an array of nano holes may involve forming the alumina template by applying an aluminum substrate to an anodizing process.

The forming a template having an array of nano holes may involve determining the geometric structure of a nano hole being included in the array of nano holes or the distance between the nano holes depending on the frequency of an electromagnetic wave that is designed to be applied to the microwave device using the nano wire array.

The filling nano holes of the array of nano holes with a metal magnetic material may involve determining the type of metal magnetic material to be used to fill the nano holes or determining amount of metal magnetic material to be used to fill the nano holes based on the frequency of an electromagnetic wave to be applied to the microwave device using the nano wire array.

The forming a template having an array of nano holes may be performed through a sputtering process, or filling the nano holes with a metal magnetic material may be performed through an electroplating process.

According to the aforementioned various embodiments of the present invention, a microwave device using a nano wire array does not require an external magnetic field, and thus a permanent magnet can be removed unlike in a conventional circulator. Accordingly, there is an effect of saving the cost and the possibility of manufacturing the circulator directly on a circulator.

Furthermore, according to the aforementioned various embodiments of the present invention, in a microwave device using a nano wire array, any metal magnetic material can be used instead of a material that has limited magnetic characteristics like a ferrite, and thus it is possible to manufacture a circulator that can operate at various microwave frequency areas.

Furthermore, according to the aforementioned various embodiments of the present invention, it is possible to integrate a circulator or isolator on a substrate and prevent a microwave device being deteriorated by the nonlinear effect at high power, thereby improving the efficiency and stability of the device.

BRIEF DESCRIPTION OF THE DRAWINGS

The above and other features and advantages of the present invention will become more apparent to those of ordinary skill in the art by describing in detail embodiments with reference to the attached drawings in which.

DETAILED DESCRIPTION

Figure 1:
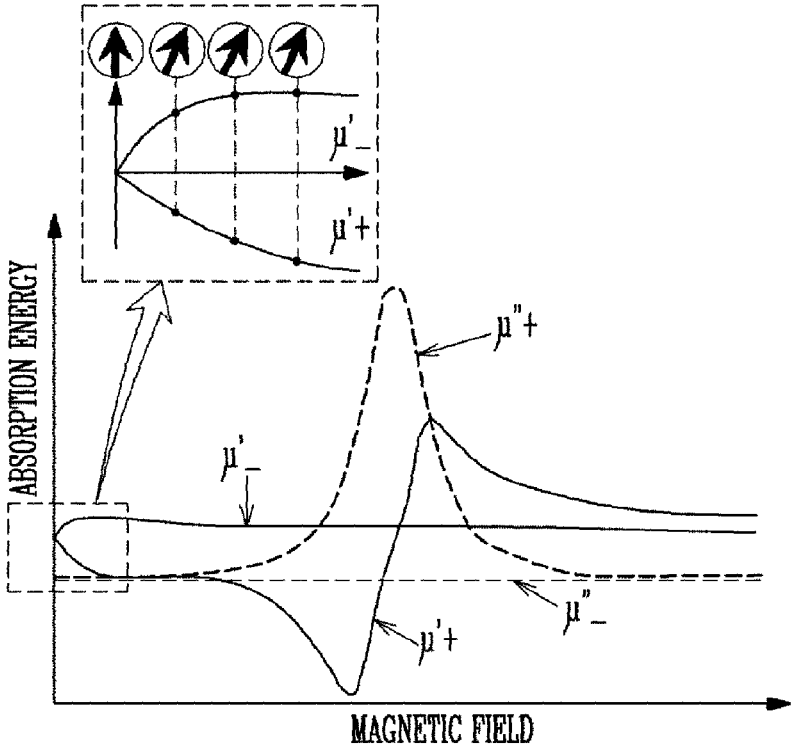
FIG. 1 (Prior art)
FIG. 1 is a view for explaining operation principles of a circulator.
Figure 2A:
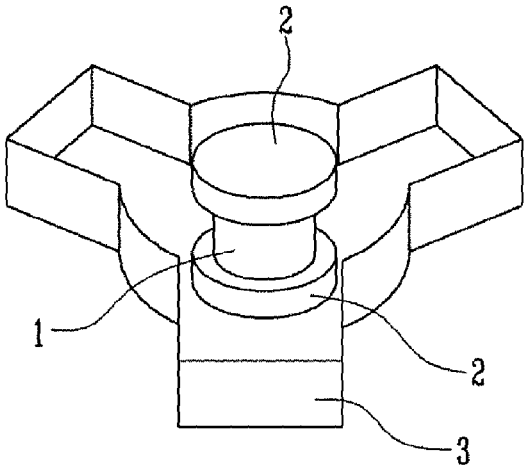
FIG. 2A (Prior art)
FIGS. 2*a* and 2*b* illustrate a conventional waveguide structure circulator and a microstrip structure circulator, respectively.
Figure 2B:
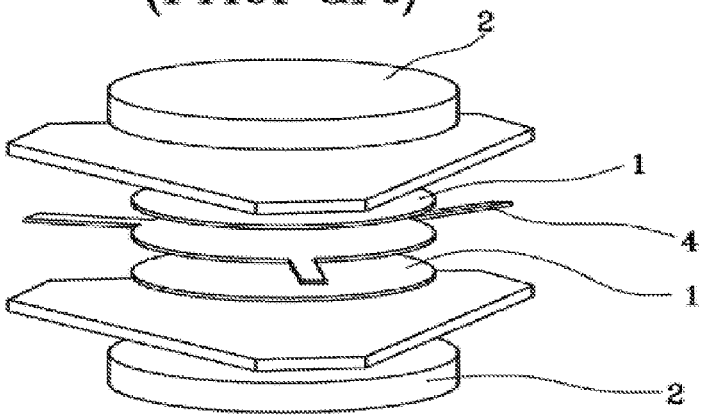
FIG. 2B (Prior art)

Hereinafter, embodiments will be described in greater detail with reference to the accompanying drawings. Embodiments are described herein with reference to cross-sectional illustrates that are schematic illustrations of embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements.

Terms such as 'first' and 'second' may be used to describe various components, but they should not limit the various components. Those terms are only used for the purpose of differentiating a component from other components. For example, a first component may be referred to as a second component, and a second component may be referred to as a first component and so forth without departing from the spirit and scope of the present invention. Furthermore, 'and/or' may include any one of or a combination of the components mentioned.

In this specification, a singular form may include a plural form as long as it is not specifically mentioned in a sentence. Furthermore, 'include/comprise' or 'including/comprising' used in the specification represents that one or more components, steps, operations, and elements exist or are added.

Furthermore, unless defined otherwise, all the terms used in this specification including technical and scientific terms have the same meanings as would be generally understood by those skilled in the related art. The terms defined in generally used dictionaries should be construed as having the same meanings as would be construed in the context of the related art, and unless clearly defined otherwise in this specification, should not be construed as having idealistic or overly formal meanings.

Figure 3:
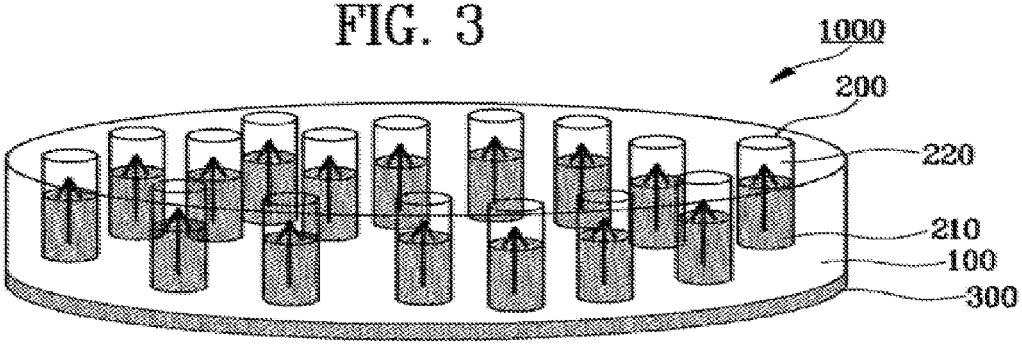
FIG. 3 is a perspective view of a microwave device using a magnetic material nano wire array according to an embodiment of the present invention.

FIG. 3 is a perspective view of a microwave device with a magnetic material nano wire array according to an embodiment of the present invention. The microwave device may be a circulator puck. Referring to FIG. 3, the microwave device 1000 using a magnetic material nano wire array includes a template 100 having a nano hole array (e.g., array of nano holes), and the nano holes of the nano hole array may be filled with a metal magnetic material 210 to form an array of magnetic material nano wires (e.g., magnetic material nano wire array). The template 100 includes a first surface 102 and a second surface 104 opposite of the first surface (see FIG. 4). As illustrated in FIG. 3, the nano hole array may include a plurality of nano holes 200, and each of the nano holes filled with the metal magnetic material forming the array of magnetic material nano wires (or simply "nano wire array").

Furthermore, the microwave device 1000 with the nano wire array filled with the metal magnetic material may further include a metal magnetic material layer 300 formed on the second surface 104 of the template 100 and on ends of each of the nano wires that are disposed in the plurality of nano holes 200. For example, the metal magnetic material layer 300 may be formed under the nano holes 200 filled with the metal magnetic material 210, as illustrated in FIG. 3.

According to an embodiment of the present invention, at least a portion of each nano hole of the nano hole array may be filled with a metal magnetic material. As illustrated in FIG. 3, according to an embodiment of the present invention, a portion of a nano hole 200 may be filled with a metal magnetic material 210, while the rest of the nano hole 200 is filled with an air layer 220.

Figure 4:
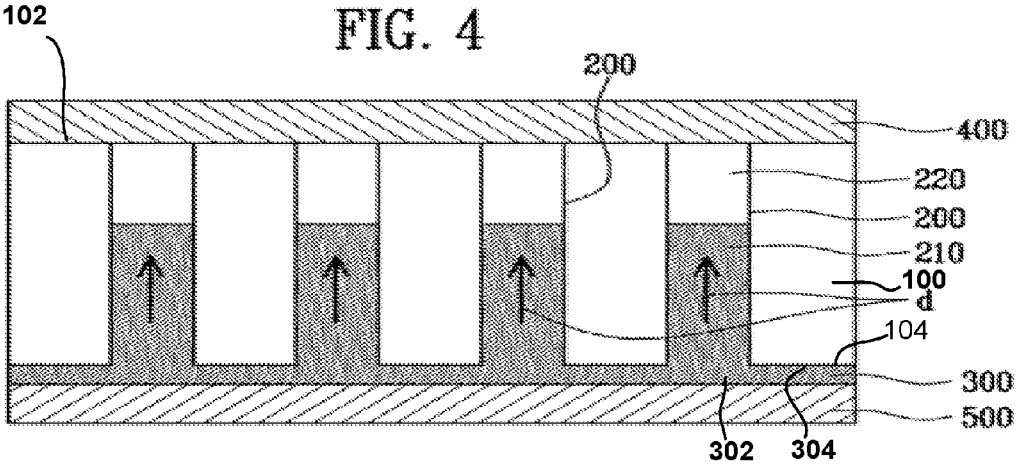
FIG. 4 is a cross-sectional view of a microwave device 1000 using a magnetic material nano wire array according to an embodiment of the present invention.

FIG. 4 is a cross-sectional view of a microwave device 1000 using a magnetic material nano wire array according to an embodiment of the present invention. Referring to FIG. 4, the microwave device 1000 with the magnetic material nano wire array may further include a first electrode 400 formed on a first surface of the template 100 and a second electrode 500 formed on a first surface 302 of the metal magnetic material layer 300 opposite to a second surface 304 of the metal magnetic material layer, the ends of the plurality of magnetic material nano wires (e.g., nano wires) formed by the metal magnetic material 210 being in contact with the second surface 304 of the metal magnetic material layer 300. For example, the first electrode 400 may be disposed on the side of the template 100 where the first surface 102 is located and the side of the template where the air layers 200 of the nano holes 200 are formed. The second electrode 500 may be disposed on the side of the template 100 where the metal magnetic material layer 300 is disposed and may be further disposed on the first surface 302 of the magnetic material layer 300 that is opposite of the second surface 304 of the magnetic material layer 300, the second surface 304 of the magnetic material layer 300 being on top of the second surface 104 of the template and in contact with the ends of the nano wires that are formed by the metal magnetic material 210 disposed in the plurality of nano holes 200. According to an embodiment of the present invention, the first electrode 400 may be, but is not limited to, a microstrip line, and the second electrode 500 may be, but is not limited to, a ground electrode. As illustrated in FIG. 4, the metal magnetic materials 210 that fills the different nano holes 200, which corresponds to different nano wires, may all have a same spin direction (d).

Figure 5:
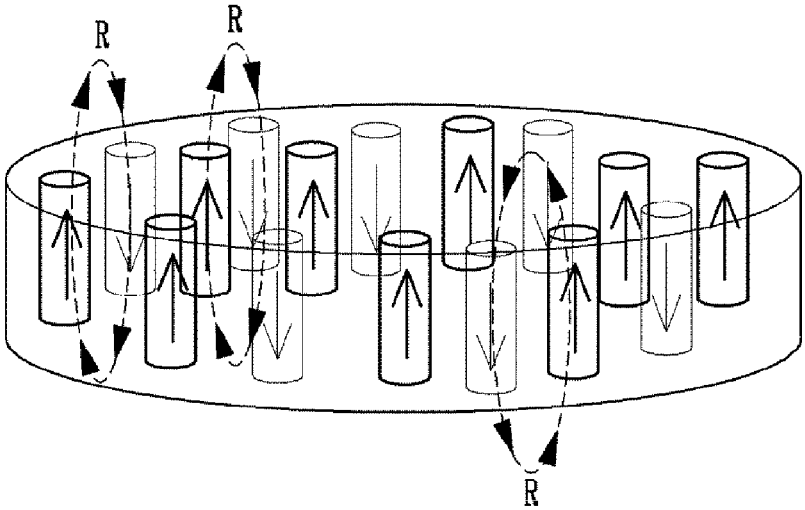
FIG. 5 is a view for explaining functions of a metal magnetic material layer 300 of a microwave device 1000 using a magnetic material nano wire array according to an embodiment of the present invention.

FIG. 5 is a view for explaining functions of a metal magnetic material layer 300 of a microwave device 1000 using a magnetic material nano wire array according to an embodiment of the present invention.

According to an embodiment of the present invention, the distance between nano holes 200 included in a nano hole array may be identical along a template 100 surface or partially different from one another. When the distance between the nano holes become closer, or when the amount of magnetic material included in the nano holes increases thereby increasing the density of the magnetic material in the nano hole array, an interaction (R) occurs between the nano holes 200 as illustrated in FIG. 5. That is, in order to minimize the magnetic energy, a nano hole including the metal magnetic material may cause magnetic dipole interaction thereby changing the direction of the magnetic pole of the metal magnetic material of an adjacent nano hole. The direction of metal magnetic materials of some of the nano holes being arranged in the opposite direction may cause a problem of non-uniform permeability, but according to an embodiment of the present invention, it is possible to form a metal magnetic material layer 300 on one surface of a template 100 so as to alleviate such magnetic dipole interaction.

According to an embodiment of the present invention, the geometric structure of a nano hole being included in a nano hole array may be, but is not limited to, a cylindrical shape as illustrated in FIG. 3. The nano hole being included in a nano hole array may have any shape such as a polygonal column.

Furthermore, at least one of the geometric structure of a nano hole being included in the nano hole array, the distance between the nano holes, the type of metal magnetic material being filled in the nano hole array, and the amount of metal magnetic material being filled in the nano hole array may be determined depending on the frequency of the electromagnetic wave being applied to the microwave device using the nano wire array.

Figure 6:
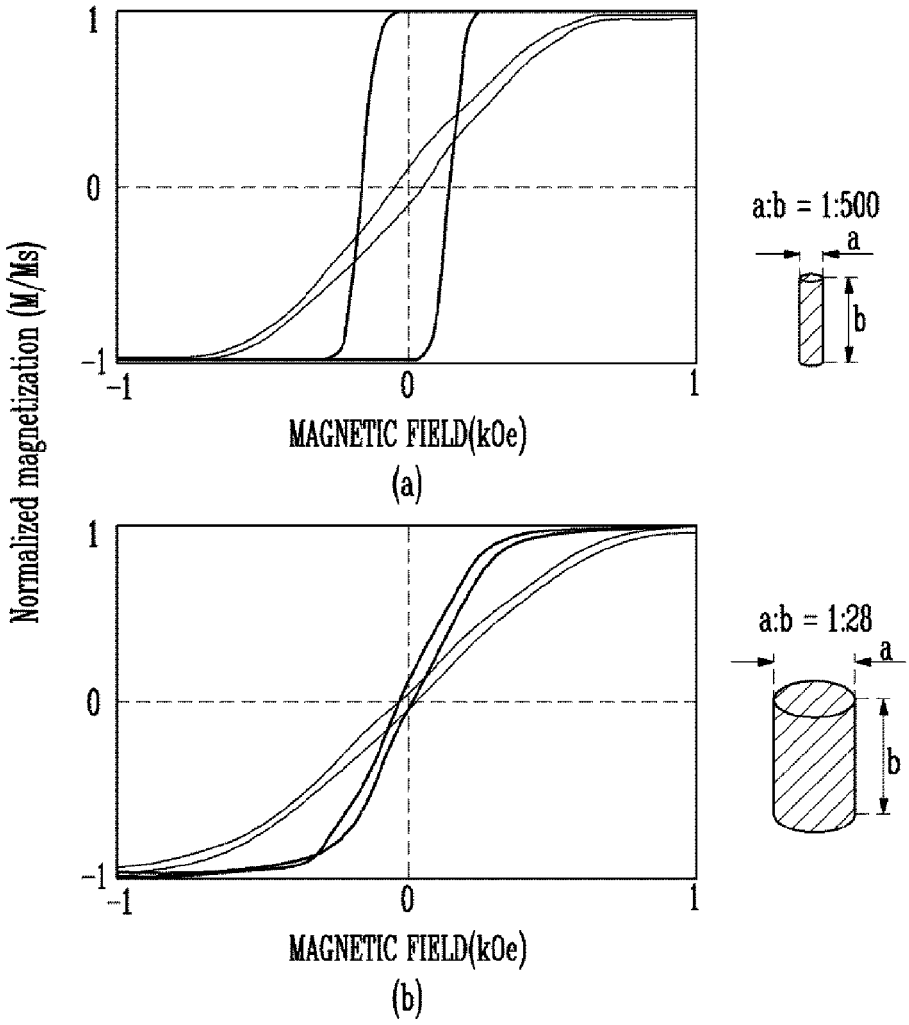
FIG. 6 are views illustrating magnetization curves according to the diameter and height of a cylindrical nano hole of a microwave device using a nano wire array according to an embodiment of the present invention.

FIG. 6 are views illustrating magnetization curves according to the diameter and height of a cylindrical nano hole of a microwave device using a nano wire array according to an embodiment of the present invention. In graphs (a) and (b) of FIG. 6, l1. L2, l1', and l2' are magnetization curves in an axis direction of nano holes, and l3, and l3' are magnetization curves in a vertical direction of a cylinder axis. Referring to graphs (a) and (b) of FIG. 6, as the ratio of diameter (a) and height (b) gets bigger, the magnetization value of when the magnetic field is 0 gets closer to a saturated magnetization value. This shows that as the magnetic material gets longer, the magnetic moment is aligned in the axis direction even when the external magnetic field is 0. Such a phenomenon is called the shape magnetic anisotropy. Using this characteristic, it is possible to adjust the diameter and height of a nano hole when necessary.

Hereinabove, only the diameter and height of a nano hole were explained, but it is possible to change the distance between the nano holes or change the type of metal magnetic material depending on the environment where the device is used.

Figure 7:
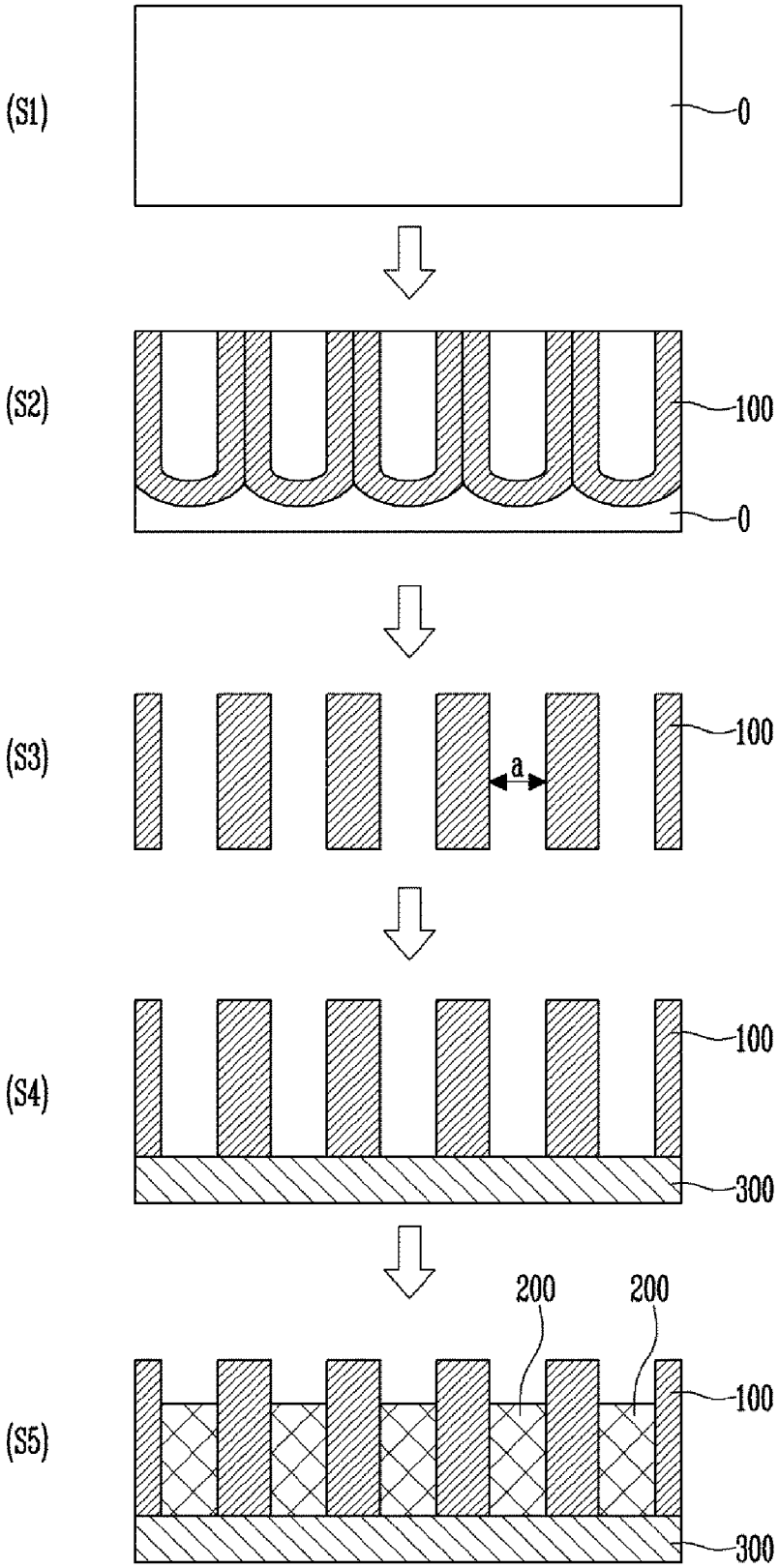
FIG. 7 illustrates cross-sectional views of each step of a method for manufacturing a microwave device using a magnetic material nano wire array according to an embodiment of the present invention.

FIG. 7 illustrates cross-sectional views of each step of a method for manufacturing a microwave device using a magnetic material nano wire array according to an embodiment of the present invention. The material (0) with which to configure a body of a circulator is prepared (S1). For example, the material may be aluminum. An anodizing process is performed on the aluminum, and a nano hole (that is, a gap) is formed (S2). Then, lower aluminum is removed (S3). Then, the gap is opened at the upper and lower end thereof, and the diameter (a) of the nano hole is adjusted if necessary. Then, a metal magnetic material layer 300 may be formed through a sputtering process (S4). As aforementioned, the metal magnetic material layer may play the role of restricting the magnetic dipole interaction between the metal magnetic materials of the nano holes.

Furthermore, a nano hole array filled with the metal magnetic material is formed by filling the nano holes with the metal magnetic material (S5). Herein, any method can be used to fill each nano hole with the metal magnetic material, and desirably an electroplating process may be used. The metal magnetic material that fills the nano holes may fill at least a portion of the nano holes. In such a case, the remaining portion of the nano holes that is not filled with the metal magnetic material may be left with an air layer. Furthermore, according to another embodiment of the present invention, the order of the aforementioned step (S4) and step (S5) may be exchanged with each other.

Figure 8:
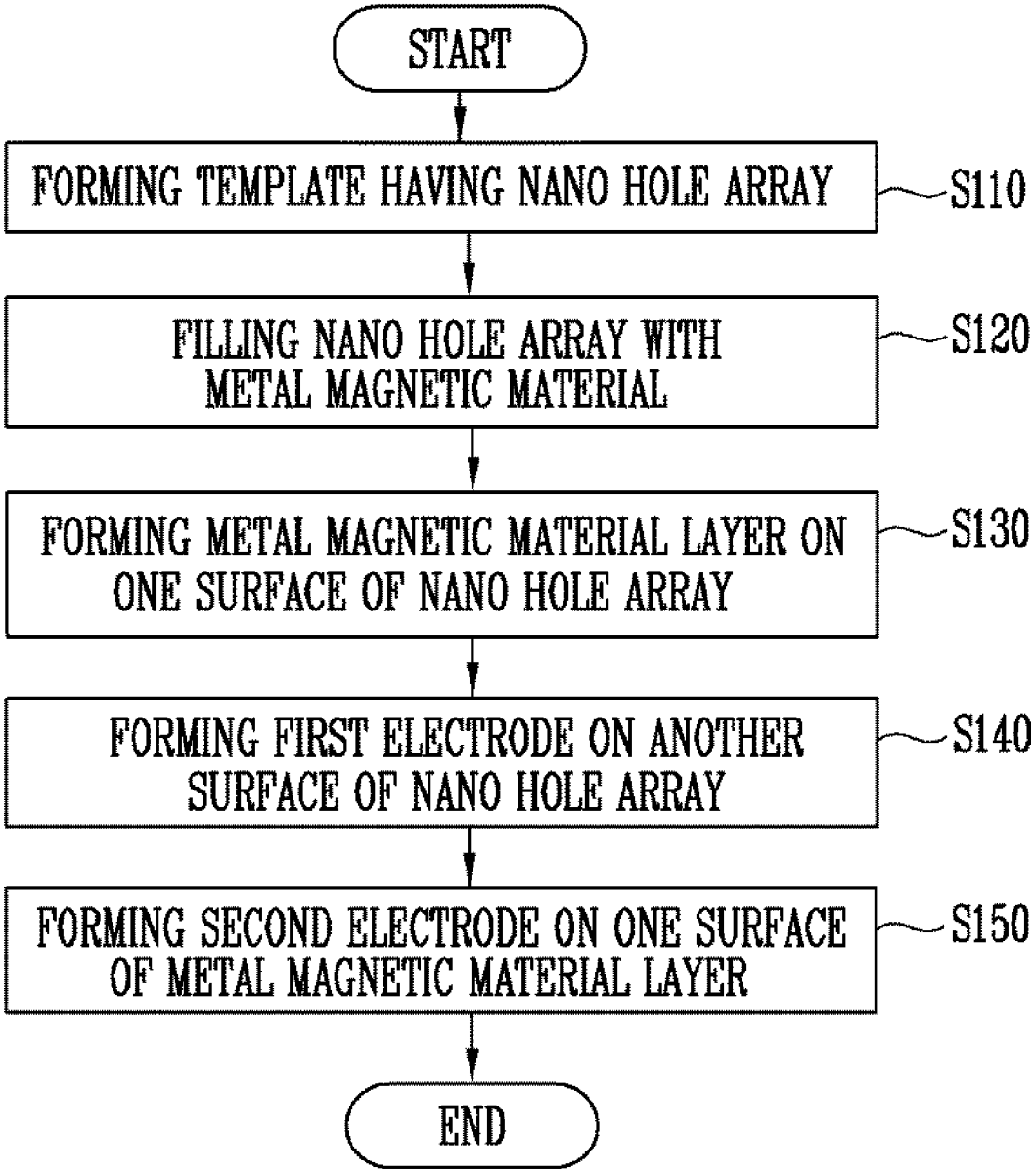
FIG. 8 is a flowchart of a method for manufacturing a microwave device using a magnetic material nano wire array according to an embodiment of the present invention.

FIG. 8 is a flowchart of a method for manufacturing a microwave device using a magnetic material nano wire array according to an embodiment of the present invention. Referring to FIG. 8, the method for manufacturing a microwave device using a magnetic material nano wire array includes forming a template having a nano hole array (S110) and filling the nano hole array with a metal magnetic material (S120). The nano holes of the nano hole array extending from a first surface of the template to a second surface of the template that is opposite of the first surface. The metal magnetic material filling the nano hole array forming an array of magnetic material nano wires, and at least one end of each of the magnetic material nano wires extending to the second surface of the template.

For example, the template may be an alumina template, and the forming a template having a nano hole array (S110) may be performed such that the alumina template is formed by applying an alumina substrate to an anodizing process.

Furthermore, according to another embodiment of the present invention, a method for manufacturing a microwave device with a magnetic material nano wire array may further include forming a metal magnetic material layer on one surface of the nano hole array (S130) by forming the metal magnetic material layer on the second surface of the template and on the ends of the magnetic material nano wires.

A method for manufacturing a microwave device using a magnetic material nano wire array according to an embodiment of the present invention may further include forming a first electrode on another surface of the nano hole array (S140) by forming the first electrode on the first surface of the template and forming a second electrode on one surface of the metal magnetic material layer that is opposite to the nano hole array (S150). The first electrode and the second electrode may be, but are not limited to, a microstrip line and a ground electrode, respectively.

According to another embodiment of the present invention, the forming a template having a nano hole array (S110) may involve determining the geometric structure of a nano hole or the distance between the nano holes depending on the frequency of an electromagnetic wave to be applied to the microwave device having the nano hole array.

According to another embodiment of the present invention, the filling the nano hole array with a metal magnetic material may involve determining the type or amount of the metal magnetic material that fills the nano hole array depending on the frequency of an electromagnetic wave to be applied to the microwave device using the nano wire array.

That is, according to an embodiment of the present invention, a microwave device using a nano wire array may adjust the distance, size and shape of a nano hole depending on the environment where it is used, and further, the device may also adjust the type and amount of the metal magnetic material to be filled in the nano holes.

In the drawings and specification, there have been disclosed typical exemplary embodiments of the invention, and although specific terms are employed, they are used in a generic and descriptive sense only and not for purposes of limitation. As for the scope of the invention, it is to be set forth in the following claims. Therefore, it will be understood by those of ordinary skill in the art that various changes in form and details may be made therein without departing from the spirit and scope of the present invention as defined by the following claims.

What is claimed is:

1. A microwave device having a magnetic material nano wire array, the device comprising:

a template having an array of nano holes, each of the nano holes extending from a first surface of the template to a second surface of the template opposite the first surface, wherein the nano holes are filled with a metal magnetic material to form an array of magnetic material nano wires, at least one end of each of the magnetic material nano wires extending to the second surface of the template; and a magnetic material layer formed on the second surface of the template and that is in contact with the ends of the magnetic material nano wires that extends to the second surface of the template.

2. The device according to claim 1, wherein geometric structure of a nano hole included in the array of nano holes includes a cylindrical shape or polygonal column shape.

3. The device according to claim 1, wherein distances between nano holes included in the array of nano holes are uniform or partially different from one another.

4. The device according to claim 1, wherein at least one of a geometric structure of a nano hole included in the array of nano holes, distance between the nano holes, type of metal magnetic material filled in the array of nano holes, and amount of metal magnetic material filled in the nano holes of the array of nano holes is determined depending on the frequency of an electromagnetic wave that is designed to be applied to the microwave device using the array of nano wires.

5. The device according to claim 1, wherein the metal magnetic material that forms each of the nano wires of the array of nano wires has the same spin direction.

6. The device according to claim 1, wherein each nano hole of the array of nano holes is only partially filled with the metal magnetic material.

7. The device according to claim 6, further comprising:

a first electrode formed on the first surface of the template; and a second electrode formed on a first surface of the metal magnetic material layer that is opposite to a second surface of the metal magnetic material layer, where the second surface of the metal magnetic material layer is disposed on the second surface of the template and on the ends of the magnetic material nano wires that extends to the second surface of the template.

8. A method for manufacturing a microwave device having a magnetic material nano wire array, the method comprising:

forming a template having an array of nano holes, each of the nano holes extending from a first surface of the template to a second surface of the template opposite the first surface;

filling the nano holes with a metal magnetic material to form an array of magnetic material nano wires, at least one end of each magnetic material nano wire extending to the second surface of the template; and forming a magnetic material layer on the second surface of the template and on the ends of the nano wires that extends to the second surface of the template.

9. The method according to claim 8, wherein the template is an alumina template, and the forming a template having an array of nano holes involves forming the alumina template by applying an aluminum substrate to an anodizing process.

10. The method according to claim 8, wherein the forming a template having an array of nano holes involves determining the geometric structure of a nano hole being included in the array of nano holes or the distance between the nano holes depending on the frequency of an electromagnetic wave that is designed to be applied to the microwave device using the nano wire array.

11. The method according to claim 10, wherein the filling nano holes of the array of nano holes with a metal magnetic material involves determining the type of metal magnetic material to be used to fill the nano holes or determining amount of metal magnetic material to be used to fill the nano holes based on the frequency of an electromagnetic wave to be applied to the microwave device using the nano wire array.

12. The method according to claim 10, wherein the forming a template having an array of nano holes is performed through a sputtering process, or filling the nano holes with a metal magnetic material is performed through an electroplating process.

13. The method according to claim 8, wherein the filling the nano holes with a metal magnetic material involves filling only a portion of each of the nano holes with the metal magnetic material.

14. The method according to claim 13, further comprising:

forming a first electrode on the first surface of the template; and forming a second electrode on a first surface of the metal magnetic material layer that is opposite to a second surface of the metal magnetic material layer, where the second surface of the metal magnetic material layer is disposed on the second surface of the template and on the ends of the magnetic material nano wires that extends to the second surface of the template.

* * * * *